US007847241B2

(12) United States Patent
Gabeler

(10) Patent No.: US 7,847,241 B2
(45) Date of Patent: Dec. 7, 2010

(54) POWER SUPPLY REGULATION USING A FEEDBACK CIRCUIT COMPRISING AN AC AND DC COMPONENT

(75) Inventor: Stephen C. Gabeler, Sudbury, MA (US)

(73) Assignee: DH Technololgies Development PTE. Ltd., Singapore (SG)

( * ) Notice: Subject to any disclaimer, the term of this patent is extended or adjusted under 35 U.S.C. 154(b) by 213 days.

(21) Appl. No.: 12/350,773

(22) Filed: Jan. 8, 2009

(65) Prior Publication Data

US 2009/0242751 A1 Oct. 1, 2009

Related U.S. Application Data

(62) Division of application No. 11/429,371, filed on May 5, 2006, now Pat. No. 7,491,931.

(51) Int. Cl.
*H01J 49/10* (2006.01)

(52) U.S. Cl. ..... 250/282; 250/281; 250/285; 250/288; 250/423 R; 250/424; 315/111.81; 315/111.91; 327/237; 327/243; 327/244

(58) Field of Classification Search ..... 250/281, 250/282, 285, 287, 288, 423 R, 424, 425, 250/426; 315/111.81, 111.91; 327/237, 327/243, 244

See application file for complete search history.

(56) References Cited

U.S. PATENT DOCUMENTS 4,121,121 A 10/1978 Gabeler
4,361,812 A 11/1982 Farrel et al.
5,668,708 A * 9/1997 Scapellati ..... 363/46
5,872,457 A 2/1999 Williams (Continued)

FOREIGN PATENT DOCUMENTS

DE 196 33 496 A1 2/1998

(Continued)

OTHER PUBLICATIONS

International Search Report, WIPO, WO/2006/079096 A3, published Jun. 7, 2007, 4 pgs.

*Primary Examiner*—Jack I Berman
*Assistant Examiner*—Michael Maskell
(74) *Attorney, Agent, or Firm*—Kurt Rauschenbach; Rauschenbach Patent Law Group, LLP

(57) ABSTRACT

In various aspects, ion sources, mass spectrometer systems, and a power supply circuit coupled to a feedback circuit are provided. A power supply is provided that includes at least the power supply circuit and is operable to transfer charge to a load. The feedback circuit is responsive to a DC component of an output voltage supplied by the power supply in a first feedback loop and an AC component of the output voltage in a second feedback loop to produce a feedback signal representative of at least one of: a value of the output voltage before a charge transfer from a capacitor of the power supply to a load; the value of the output voltage during the charge transfer from the capacitor of the power supply to the load; or the value of the output voltage after the charge transfer from the capacitor of the power supply to the load.

5 Claims, 12 Drawing Sheets

U.S. PATENT DOCUMENTS

| | | | | |
|---|---|---|---|---|
| 6,586,731 | B1 | 7/2003 | Jolliffe | |
| 7,253,403 | B2 * | 8/2007 | Reilly et al. | 250/281 |
| 7,372,023 | B2 | 5/2008 | Sobek et al. | |
| 2001/0042836 | A1 * | 11/2001 | Olson et al. | 250/424 |
| 2005/0017799 | A1 | 1/2005 | Risbo | |

FOREIGN PATENT DOCUMENTS

| | | | |
|---|---|---|---|
| EP | 0217644 | A2 | 4/1984 |
| EP | 0 427 532 | A2 | 5/1991 |
| WO | 8300258 | | 1/1983 |

* cited by examiner

POWER SUPPLY REGULATION USING A FEEDBACK CIRCUIT COMPRISING AN AC AND DC COMPONENT

CROSS-REFERENCES TO RELATED APPLICATIONS

This application is a divisional patent application of U.S. patent application Ser. No. 11/429,371, filed on May 5, 2006, entitled Power Supply Regulation Using A Feedback Circuit Comprising An AC And DC Component. The entire disclosure of U.S. patent application Ser. No. 11/429,371 is incorporated herein by reference.

INTRODUCTION

The development of matrix-assisted laser desorption/ionization ("MALDI") techniques has greatly increased the range of biomolecules that can be studied with mass analyzers. MALDI techniques allow normally nonvolatile molecules to be ionized to produce intact molecular ions in a gas phase that are suitable for analysis. One class of MALDI instrument, which have found particular use in the study of biomolecules, are MALDI tandem time-of-flight mass spectrometers, referred to as MALDI-TOF MS/MS instruments hereafter.

A traditional tandem mass spectrometer (MS/MS) instrument uses multiple mass separators in series. Traditional MS/MS techniques use a first mass separator (often referred to as the first dimension of mass spectrometry) to transmit molecular ions in a selected mass-to-charge (m/z) range (often referred to as "the parent ions" or "the precursor ions") to an ion fragmentor (e.g., a collision cell, photodissociation region, etc.) to produce fragment ions (often referred to as "daughter ions") of which a mass spectrum is obtained using a second mass separator (often referred to as the second dimension of mass spectrometry).

Time-of-flight (TOF) mass spectrometers distinguish ions on the basis of the ratio of the mass of the ion to the charge of the ion, often abbreviated as m/z. Traditional TOF techniques rely upon the fact that ions of different mass-to-charge ratios (m/z) achieve different velocities if they are all exposed to the same electrical field; and as a result, the time it takes an ion to reach the detector (called the ion arrival time or time of flight) is representative of the ion mass. In theory, each ion of a given mass-to-charge ratio should have a unique arrival time. As a result, a mixture of ions of different mass should produce a spectrum of arrival time signals each corresponding to a different ion mass. Such spectra are commonly referred to as arrival time spectra or simply, mass spectra. In practice, however, achieving accurate results is not easy, and the greater the accuracy required in the analysis, the more difficult the task.

In many biomolecule studies (such as, e.g., proteomics studies) that employ mass analyzers the biomolecule masses of interest can readily span two or more orders of magnitude. In addition, in many biological studies there is a limited amount of sample available for study (such as, e.g., rare proteins, forensic samples, archeological samples).

In a tandem mass spectrometer (MS/MS), it is also generally desirable to control the collision energy of the ions prior to the ions entering the ion fragmentor, e.g., a collision cell. Typically, this is done in a TOF/TOF tandem mass spectrometer by first accelerating the ions from the first TOF region (first dimension of MS) to an initial energy and then decelerating the ions to the desired collision energy by adjusting the electrical potential on the collision cell entrance.

MALDI-TOF MS/MS instruments can be very complex machines requiring the accurate alignment and interaction of myriad components for useful operation. Mass spectrometry requires ion optics to focus, accelerate, decelerate, steer and select ions. Misalignment of these components and non-uniformity in their electrical fields can significantly degrade the performance of a mass spectrometry instrument.

Of further importance is providing precise regulation of a power supply that is used for accelerating and decelerating the ions. Pulsed ion sources used in time of flight mass spectrometers and other scientific instruments use pulsed electric fields to accelerate ions to a predetermined energy. Precise regulation of the power supply is important to providing accurate results. Slight variations in the predetermined energy supplied by the power supply affects the time it takes the ion to reach the detector. That is, supplying less energy than the predetermined energy causes the ion to take more time to reach the detector, and supplying more energy than the predetermined energy causes the ion to take less time to reach the detector. Thus, even interactions among a voltage supplied by the power supply to the electrodes that are used for accelerating the ions to the predetermined energy, and the electrodes themselves determine the precision and stability of the energy transferred to each pulse of ions.

To produce the pulsed electric field used in time of flight mass spectrometers the power source is connected and disconnected to the electrode(s) through a switch. When the switch is open the power supply is disconnected from the electrode(s) and the power supply charges a storage capacitor coupled to the output of the power supply. When the switch is closed the charge held by the storage capacitor is transferred to the electrode(s). The charge transfer from the storage capacitor in combination with the capacitance of electrode(s) and the associated cabling causes an abrupt drop in output voltage of the power supply. Because the output voltage of the power supply immediately after the charge transfer to the electrode(s) determines the energy of the accelerated ions, precision regulation of the output voltage of the power supply immediately after the charge transfer is desirable in a time of flight mass spectrometry system.

One conventional voltage regulation technique that is used in power supplies associated with TOF MS/MS is to regulate a filtered average or average DC offset of the output voltage waveform. This type of voltage regulation produces a sawtooth waveform, where the output voltage increases when the power supply is not connected to the load and quickly drops when the power supply is connected to the load. The sawtooth waveform is produced due to the charge transfer from the power supply to the load. Variations in capacitance of the load causes the amplitude of the waveform to vary, however, the average value of the waveform remains constant. As a result, the minimum value of the waveform varies with variations in the capacitance of the load. In systems that use pulsed electric fields, such as the TOF MS, this type of voltage regulation is inadequate because it does not regulate the output voltage of a power supply after the charge transfer.

Another conventional regulation technique that is used in power supplies that are connected and disconnected to a load is to recharge a storage capacitor of the power supply, as quickly as possible after the charge transfer, from the storage capacitance to the load. With this approach it is very difficult to control overshoot and ringing, and there is a pulse repetition rate where the feedback control system becomes unstable. If the ringing has not fully damped out before the next pulse occurs, the regulation becomes erratic. This regulation technique regulates the voltage before the pulse, but not after the pulse and variations in the capacitance of the load causes the output voltage after the charge transfer to vary.

SUMMARY

In various aspects the present teachings provide apparatus and methods that facilitate increasing the precision with which an output voltage at an output node of a power supply circuit after a charge transfer from the power supply circuit to a load can be regulated. The load can comprise a first electrode and a second electrode of an ion source for a mass analyzer. The feedback circuit includes two feedback loops for regulating the output voltage after the charge transfer. A first feedback loop is responsive to a DC component of the output voltage and produces a first feedback signal. A second feedback loop is responsive to an AC component of the output voltage and produces a second feedback signal. The feedback circuit produces a feedback signal on an output node of the feedback circuit to regulate the output voltage of the power supply circuit after a charge transfer from the power supply circuit to a load. The feedback signal used to regulate the output voltage of a power supply circuit is based on the first feedback signal and the second feedback signal.

In various embodiments, provided are ion sources for a mass analyzer where the ion source power supply comprises a power supply circuit and feedback circuit of the present teachings. The power source includes a power supply circuit and a feedback circuit and is electrically coupled to the first electrode and the second electrode. In various embodiments, the load of the power supply circuit comprises a first electrode and a second electrode of the ion source. In various embodiments, an electrical potential difference established between the first electrode and the second electrode by the power supply circuit is used to accelerate ions into the mass analyzer. A wide variety of ion sources can be use with the power supply circuits of the present teachings, including, but not limited to, matrix-assisted laser desorption/ionization (MALDI) sources where a sample support can comprise the first electrode, and so called virtual ion sources that provide a timing point for ion origination but do not necessarily create ions from neutrals, such as, e.g., at the exit of collision cells employing delayed extraction, at deflector regions employed in orthogonal time-of-flight (O-TOF), instruments, etc.

The power supply circuit of the power source has at least one output node that is coupled through a switch to at least one of the first electrode and the second electrode. The power supply circuit supplies an electric potential to at least one of the first electrode and the second electrode to establish an electric field at a predetermined time.

The feedback circuit is responsive to a DC component and an AC component of an output voltage supplied by the power supply to produce a feedback signal on an output node of the feedback circuit representative of at least one of, a value of the output voltage prior to a charge transfer from a capacitor associated with the power supply to at least one of the first electrode and the second electrode; the value of the output voltage during the charge transfer from the capacitor associated with the power supply to at least one of the first electrode and the second electrode; or the value of the output voltage after the charge transfer from the capacitor associated with the power supply to at least one of the first electrode and the second electrode.

In various embodiments, the present teachings disclose a method for regulating an output of a power supply circuit. The method provides the steps of receiving a first feedback signal from an output of a power supply circuit, and receiving a second feedback signal from a ripple component of the output of the power supply circuit. The method further provides the steps of summing the first feedback signal and the second feedback signal to generate a summed signal, and determining the difference between the reference signal and the summed signal. In a further step the method provides generating an error signal based on the first feedback signal, the second feedback signal and a reference signal, whereby the power supply circuit is responsive to the error signal to regulate the output.

In various embodiments, the present teachings disclose a power supply feedback circuit for a mass spectrometer. The feedback circuit includes a first feedback loop and a second feedback loop. The first feedback loop is configured to produce a first signal representing a DC component of an output of a power supply circuit. The second feedback loop is configured to produce a second signal representing an AC component of the output of the power supply circuit. The feedback circuit also includes an control amplifier circuit that is configured to produce an error signal based on the first signal, the second signal and a reference signal.

BRIEF DESCRIPTION OF THE DRAWINGS

The foregoing and other objects, aspects, features, and advantages of the invention will become more apparent and may be better understood by referring to the following description taken in conjunction with the accompanying drawings, in which.

DETAILED DESCRIPTION OF VARIOUS EMBODIMENTS

In various embodiments of the present teachings, a regulation scheme is provided that facilitates precise regulation of an output voltage of a power supply circuit after a charge transfer from the power supply circuit to a load. The load can comprise a first electrode and a second electrode in a mass analyzer. The load can exhibit variations in a capacitance value. The power supply circuit is coupled to the load through a switch. The switch is operable to connect and disconnect the power supply from the load periodically. When the switch connects the power supply circuit to the load a charge transfer from the power supply circuit to the load occurs.

To regulate the output voltage of the power supply circuit after the charge transfer a feedback circuit that includes two feedback loops is provided. A first feedback loop is provided that is responsive to a DC component of the output voltage. The first feedback loop produces a first feedback signal based on the DC component of the output voltage. The first feedback signal passes through a voltage divider and a filter. A second feedback loop is provided that is responsive to an AC component of the output voltage. The second feedback loop produces a second feedback signal that is based on the AC component of the output voltage. The second feedback signal passes through an AC coupler, a divider, a signal conditioning circuit, another divider, and a filter.

The first and second feedback signals from the first and second feedback loop are input into a summing circuit. The summing circuit sums the first feedback signal and the second feedback signal to produce a summed signal. The summed signal is then passed to a control amplifier where the summed signal is compared to a reference signal. The difference between the reference signal and the summed signal produces a feedback signal on an output node of the feedback circuit. The power supply circuit is responsive to the feedback signal to regulate the output voltage of the power supply circuit after a charge transfer from the power supply circuit to a load.

Figure 1:
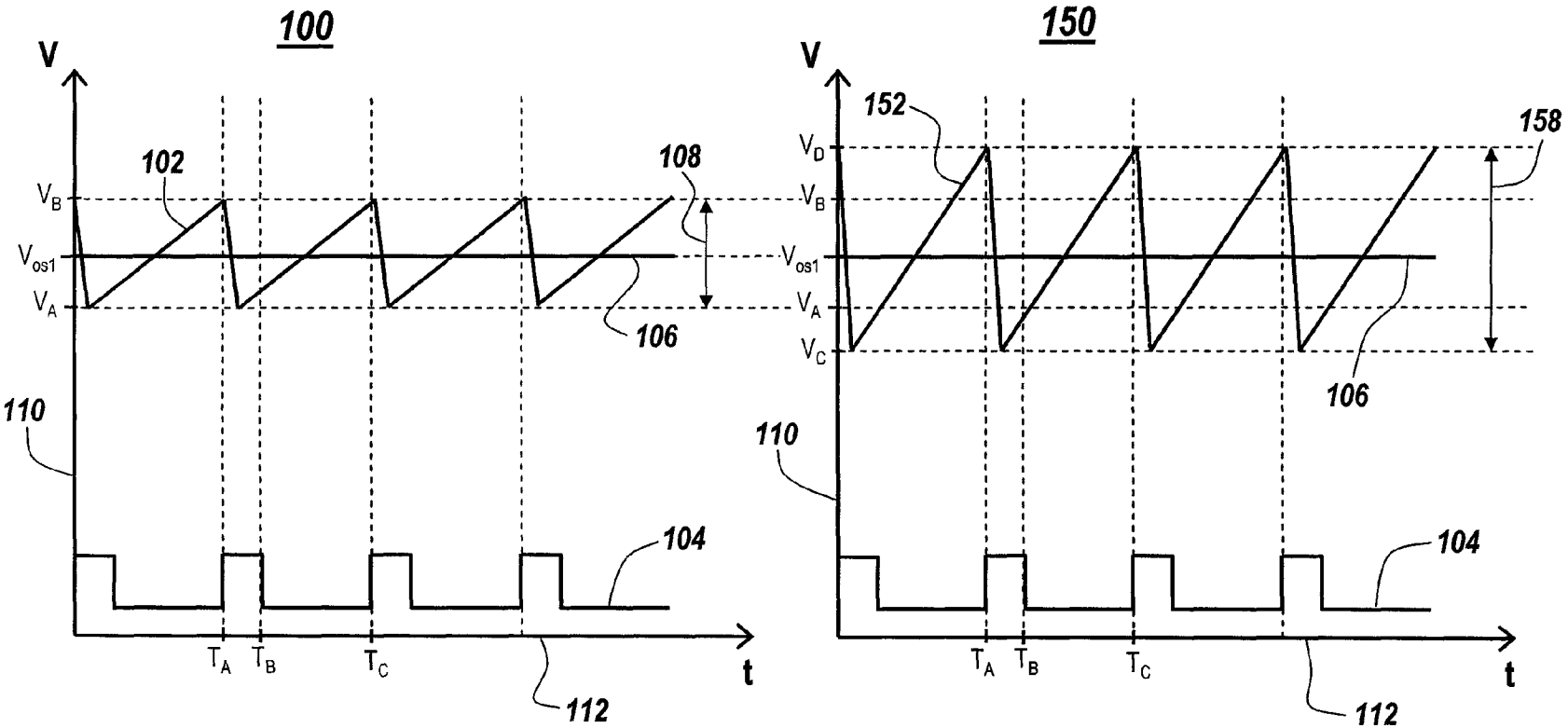
FIG. 1 graphically depicts exemplary waveforms when using a conventional filtered output (or the average DC offset) regulation scheme.

FIG. 1 graphically illustrates output waveforms of a conventional power supply regulation scheme using a filtered average of an output voltage supplied by the conventional power supply (not shown). The filtered average regulation scheme provides continuous feedback from an output of the convention power supply to a control node of the power supply and is operable to regulate the average value of the output voltage. Graph 100 illustrates an output voltage waveform 102 supplied by the conventional power supply. Graph 100 has a Y-axis 110 that corresponds to voltage and an X-axis 112 that corresponds to time. As shown in graph 100, the output voltage waveform 102 is represented by a saw-tooth ripple that rides on an average DC offset 106. The output voltage waveform has an amplitude 108, which is determined by the difference between peak voltages $V_A$ and $V_B$. Also shown in graph 100 is a periodic pulse signal 104. The periodic pulse signal 104 is used to control a switch (not shown). The switch is operable to connect the output of the conventional power supply to a load (not shown) that has some capacitance value. When the periodic pulse signal 104 is high the switch is closed, thereby connecting the output of the conventional power supply to the load. When the periodic pulse signal 104 is low the switch is open and the conventional power supply is disconnected from the load. In this manner, the load is periodically connected to the conventional power supply using the switch.

The output of the conventional power supply is coupled to a storage capacitor, which is charged when the switch is open. Upon closing the switch, the charge stored in the storage capacitor is transferred to the load. For example, when the pulse signal 104 goes high at $T_A$, the switch is closed connecting the output of the conventional power supply to the load. This causes a charge transfer from the conventional power supply to the load and causes the output voltage waveform 102 of the conventional power supply to drop. At time $T_B$, the switch is open and the conventional power supply is disconnected from the load. From time $T_B$ to time $T_C$ the conventional power supply is disconnected from the load and is recharging the storage capacitor. The output voltage waveform 102 steadily increases until the switch is closed again at time $T_C$. At time $T_C$, the switch is closed again and there is again a charge transfer from the storage capacitor to the load, which causes a drop in the output voltage waveform 102. The process described above repeats according to the frequency of the pulse signal 104.

Graph 150 shows the affect on an output voltage waveform 152 when the value of the capacitance of the load is increased. An amplitude 158 of the saw-tooth ripple of the output voltage waveform 152, which is determined by the difference between peak voltages $V_C$ and $V_D$, increases as compared to the amplitude 108 of the saw-tooth ripple of the output voltage waveform 102, but the average DC offset 106 remains the same value of $V_{OS1}$. It is therefore observed that this conventional regulation scheme provides adequate regulation of the average DC offset 106, but does not regulate an output voltage waveform when there are incremental increases in the capacitance of the load. That is, while the average DC offset 106 remains at the value $V_{OS1}$ when the load capacitance changes, the amplitude of the output voltage waveform changes from the amplitude 108 to the amplitude 158 and the output voltage after the charge transfer from the power supply to the load decreases from the voltage $V_A$ to the voltage $V_C$. The increase in amplitude of the output voltage is proportional to the change in the capacitance of the load. As a result of the conventional regulation scheme, the voltage after a charge transfer from the power supply to the load is not regulated.

There are many systems that benefit from this type of regulation scheme. Nonetheless, the use of this conventional regulation scheme can be inadequate in scientific instruments that use pulsed electric fields to accelerate ions to a predetermined energy, such as a time of flight mass spectrometer. Accurate results in time of flight mass spectrometery rely on precise control of ion acceleration. For example, in various embodiments, to control the acceleration of the ions with precision, the output voltage of the power supply after a charge transfer from the power supply to the load is regulated because this voltage provides the electric field that accelerates the ions to a predetermined energy.

Figure 2A:
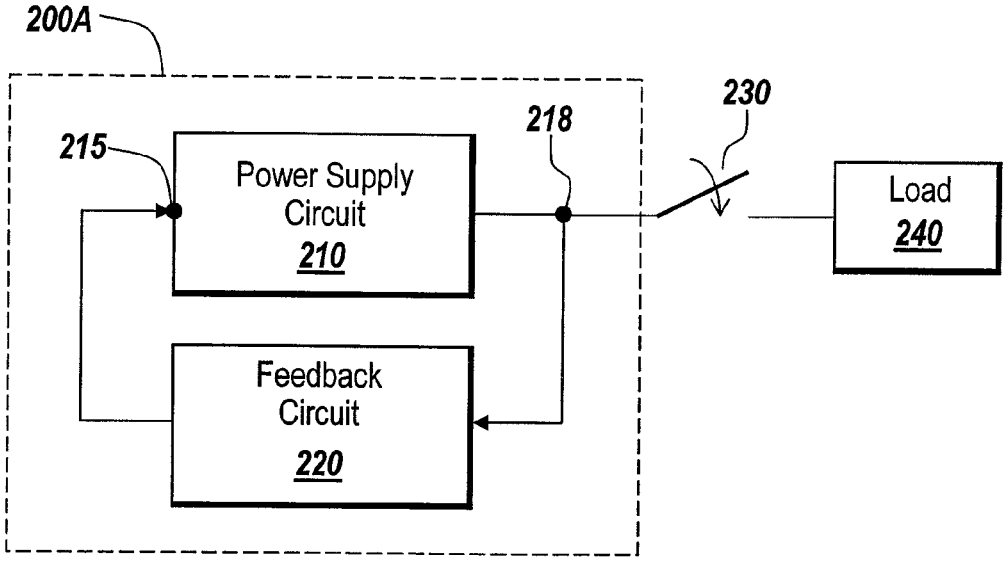
FIG. 2A depicts a block diagram of a circuit topology suitable for practicing various embodiments of the present teachings.

FIG. 2A depicts a circuit topology for practicing the present teachings. The circuit topology includes a power supply 200A, a load 240 and a switch 230 that is operable to connect the power supply to the load. Power supply 200A includes a power supply circuit 210 and a feedback circuit 220. An input node of the feedback circuit 220 is coupled to an output node 218 of the power supply circuit 210, and an output node of the feedback circuit is coupled to a control node 215 of the power supply circuit 210. The feedback circuit 220 is operable to receive an output voltage from the power supply circuit 210. The feedback circuit 220 is operable to output a feedback signal, which may be referred to as an error signal to the control node 215 of the power supply circuit 210. The power supply circuit 210 is responsive to the feedback signal to regulate the output voltage of the power supply circuit 210 after a charge transfer from the power supply circuit 210 to the load 240.

Figure 2B:
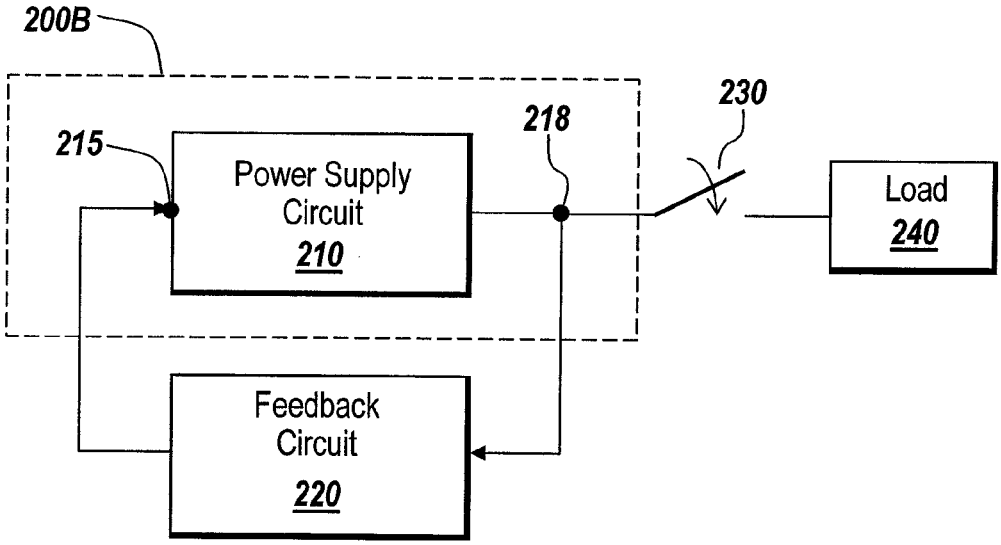
FIG. 2B depicts another block diagram of a circuit topology suitable for practicing various embodiments of the present teachings.

FIG. 2B depicts another circuit topology that is suitable for practicing the present teachings. The circuit topology includes a power supply 200B, the load 240, the switch 230, and the feedback circuit 220. The power supply 200B includes the power supply circuit 210. An input node of the feedback circuit 220 is coupled to an output node 218 of the power supply circuit 210, and an output node of the feedback circuit is coupled to the control node 215 of the power supply 210. The feedback circuit 220 is operable to receive an output voltage from the power supply circuit and to output a feedback signal, which may also be referred to as an error signal, to the control node 215 of the power supply circuit 210. The power supply circuit 210 is responsive to the feedback signal or error signal to regulate the output voltage of the power supply circuit 210 after a charge transfer from the power supply circuit 210 to the load 240.

The power supply 200A can be manufactured as a unit to include the power supply circuit 210 and the feedback circuit 220. The power supply 200A, therefore, would be manufactured to regulate the output voltage of the power supply 200A after a charge transfer from the power supply circuit 210 to the load 240. The power supply 200B can be manufactured to include the power supply circuit 210 but not the feedback circuit 220. The power supply 200B can be an off-the-shelf power supply that has been manufactured for general use, and therefore, does not regulate the output voltage of the power supply 200B after a charge transfer from the power supply circuit 210 to the load 240. Nevertheless, the feedback circuit 220 can be used with the power supply 200B to provide regulation of the output voltage of the power supply 200B after a charge transfer from the power supply circuit 210 to the load 240.

In various embodiments, feedback circuit 220 can be configured to receive multiple inputs from the output of the power supply circuit 210. The power supply circuit 210 can receive a feedback signal from the feedback circuit 220, which may also be referred to as an error signal. While switch 230 is depicted to reside external to the power supplies 200A and 200B, one skilled in the art will recognize that the switch 230 can reside internal to the power supplies 200A and 200B. The power supplies 200A and 200B are hereafter referred to for the sake of conciseness simply as power supply 200. One skilled in the art will recognize that either power supply 200A or 200B can be implemented in accordance with the present teachings where reference is made to power supply 200; for example, if power supply 200B is used it is understood that a feedback circuit 220 is coupled to the power supply circuit 210.

Figure 2C:
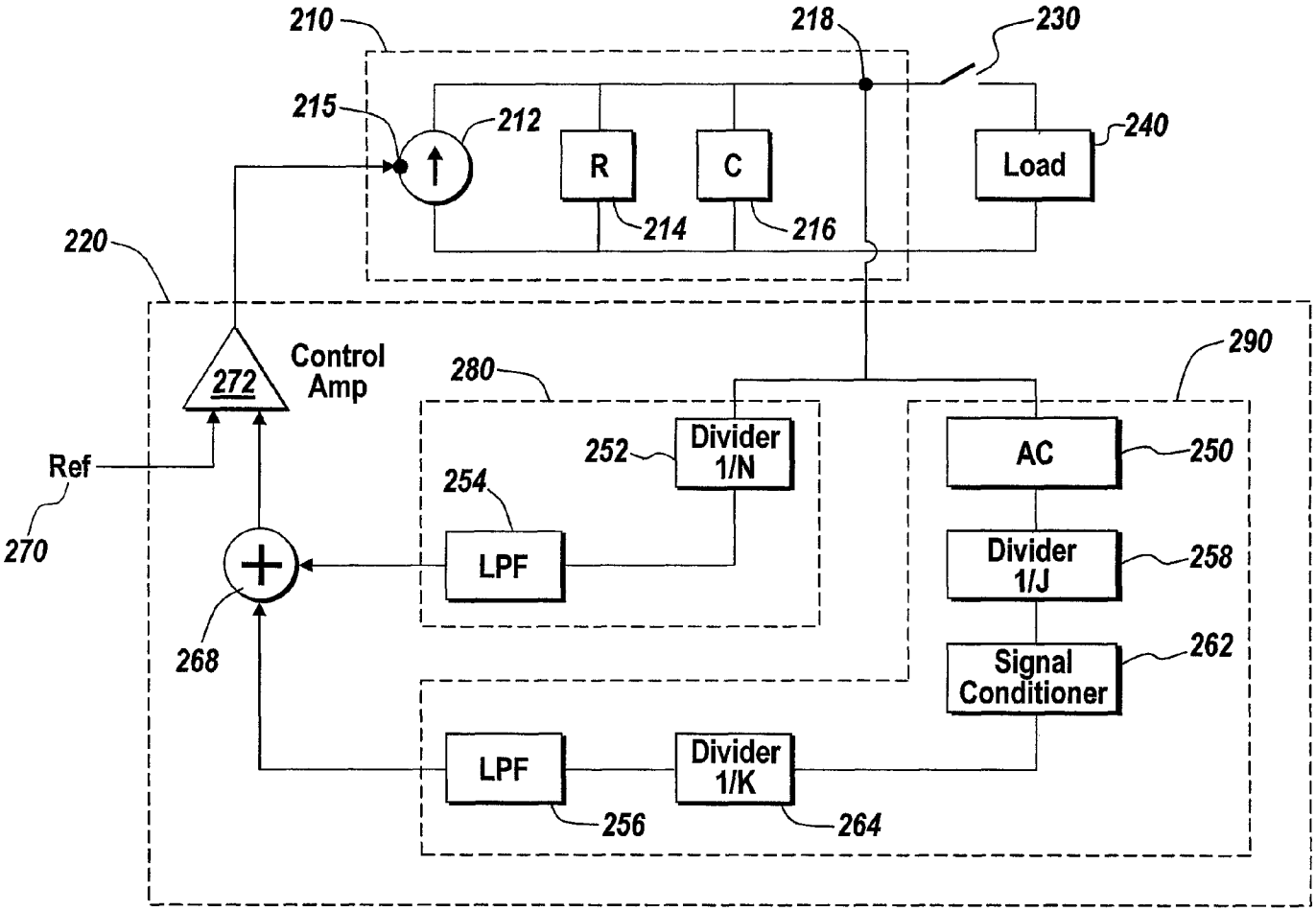
FIG. 2C depicts a more detail block diagram representation of various embodiments of the present teachings.

FIG. 2C depicts in more detail a block diagram of the power supply circuit 210 and the feedback circuit 220 in accordance with the present teachings of power supply 200. The block diagram includes the power supply circuit 210, the load 240, the switch 230, which is operable to connect the power supply circuit 210 to the load 240, and the feedback circuit 220.

The power supply circuit 210 includes a high voltage current source 212, a resistive element 214, and a capacitive element 216. The high voltage current source 212 is coupled in parallel to the resistive element 214, and the capacitive element 216. The power supply circuit 210 has an output node 218, which is coupled to one side of the switch 230. The other side of the switch 230 is coupled to the load 240. The capacitive element 216 functions to store a charge received from the high voltage current source 212 when the switch 230 is open, and to transfer the charge stored to the load 240 upon the closing of the switch 230. While the capacitive element 216 is depicted as residing within the power supply circuit 210, one skilled in the art would recognize that the capacitive element 216 can be external to the power supply circuit 210, and thus, the power supply 200.

The load 240 can be any component that can be connected to the output of the power supply circuit 210. One example of a suitable load can be an electrode in a time of flight mass spectrometer system. As discussed herein, the load 240 can be connected to the power supply circuit 210 by the switch 230. In a time of flight mass spectrometer system, for example, the load 240 receives the charge from the power supply 210 to create an electric field that can be used, e.g., to accelerates ions to a predetermined energy.

The feedback circuit 220 is coupled to the output node 218 of power supply circuit 210. The feedback circuit 220 includes a first feedback loop 280, a second feedback loop 290, a summing circuit 268 and a control amplifier 272.

The first feedback loop 280 includes a divider 252 and an optional filter 254. The input of the divider 252 is connected to the output node 218 of the power supply circuit 210 and the output of the divider 252 is connected to the input of the filter 254. The output of the filter 254 is connected to an input of the summing circuit 268. The first feedback loop 280 is responsive to a DC component of an output voltage at the output node 218 of the power supply circuit 210 and is configured to produce a first feedback signal that represents the DC component of the output voltage.

In operation, the divider 252 receives the first feedback signal and divides it by a value of 1/N. The divider outputs the divided first feedback signal to the filter 254. The filter 254, for example, a low pass filter, functions to filter the first feedback signal after it has been divided and passes the first feedback signal to the summing circuit 268.

The second feedback loop 290 includes an AC coupler 250, divider 258, divider 264, a signal conditioning circuit 262 and an optional filter 256 for example, a low pass filter. The AC coupler 250 is coupled to the output node 218 of the power supply circuit 210 and to the divider 258. The output of the divider 258 is connected to the signal conditioning circuit 262. The output of the signal conditioning circuit 262 is connected to an input node of the divider 264. The output of the divider passes through the filter 256. The output of filter 256 is connected to an input of the summing circuit 268.

In operation, the second feedback loop 290 is responsive to an AC component of the output voltage at the output node 218 of the power supply circuit 210 and is configured to produce a second feedback signal that represents the AC component of the output voltage. The AC coupler 250 operates to provide the second feedback loop 290 with the AC component of the output voltage or a second feedback signal. The second feedback signal is received by the divider 258, which divides the second feedback signal by a value of 1/J. The second feedback signal is output from the divider 258 and received by the signal conditioning circuit 262 after being divided. The signal conditioning circuit 262 is operable to rectify the second feedback signal, thus converting the second feedback signal into a DC signal. The second feedback signal is output from the signal conditioning circuit 262 and is received the divider 264, which divides the second feedback signal by a value of 1/K after it has been rectified. The second feedback signal then passes through the filter 256, which functions to filter the second feedback signal. The second feedback signal, having been filtered, is output from filter 256 and received by the summing circuit 268.

The input of the summing circuit 268 is coupled to the outputs of the filters 254 and 256 and the output of the summing circuit 268 is coupled to one input of the control amplifier 272. The summing circuit 268 receives the first feedback signal and the second feedback signal from the first feedback loop 280 and the second feedback loop 290, respectively. The summing circuit 268 operates to sum the first feedback signal and the second feedback signal to produce a summed signal. The summed signal is output from the summing circuit 268 to the control amplifier 272.

The control amplifier 272 receives the summed signal from the summing circuit 268 and receives a reference signal 270 from a reference source (not shown) and outputs a feedback signal to the power supply circuit 210. The control amplifier 272 determines the difference between the summed signal and the reference signal 270 and outputs the difference as a feedback signal or error signal to the control node 215 of the power supply circuit 210. The power supply circuit 210 is responsive to the feedback signal to regulate the value of the output voltage after a charge transfer from the power supply circuit 210 to the load 240 at the output node 218 of the power supply circuit 210. In time of flight mass spectrometer the voltage after a charge transfer can be used, for example, to provide an electric field in the mass spectrometer system to accelerate sample ions to a predetermined energy. Therefore, an increase in the precision of the regulation of the output voltage of the power supply circuit 210 after a charge transfer from the power supply circuit 210 to the load 240 facilitates accurately accelerating the ions to a predetermined energy.

The values of the dividers 252, 258, and 264 are set such that the product of the ratios of the dividers 258 and 264 is substantially equal to the ratio of the divider 252. Mathematically, the values are chosen such that $$1/N=1/J*1/K,$$

where 1/N is the value of the divider 252, 1/J is the value of the divider 258 and 1/K is the value of the divider 264.

It would be recognized by one skilled in the art in light of the present teachings that slight differences in the values of the dividers such that the resultant of the dividers 258 and 264 do not equal the exact value of the divider 252 and, if so, does not make the present teaching inoperable, but merely results in a less accurate feedback signal, and therefore, a less precise regulation of power supply circuit 210. It would also be recognized by one skilled in the art in light of the present teachings that while it is generally preferred that the resultant of the dividers 258 and 264 substantial equal the divider 252, element mismatch, element tolerances or thermal coefficients may affect the actual value of the dividers 252, 258, and 264.

Figure 3:
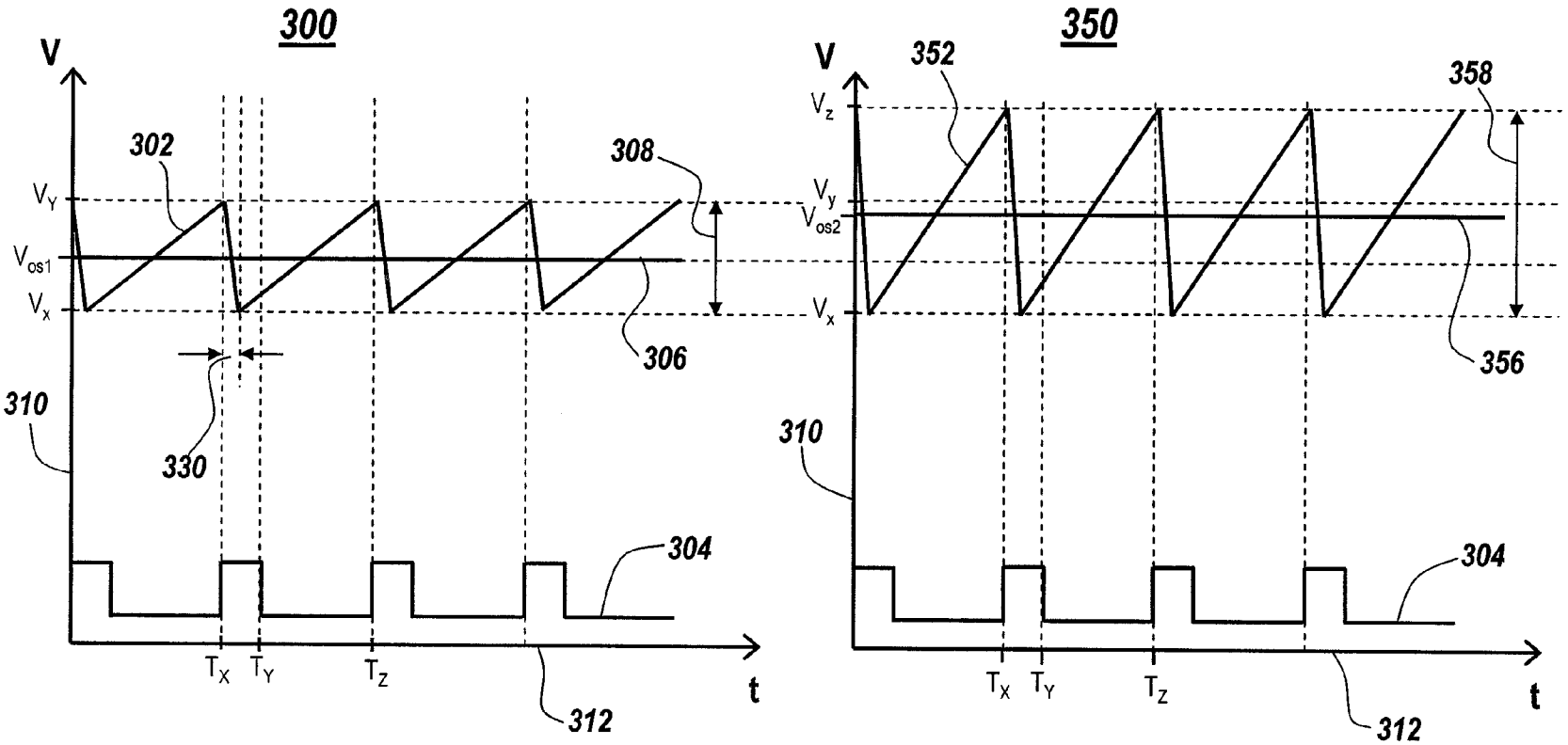
FIG. 3 graphically depicts representative waveforms when using the regulation scheme of various embodiments of the present teachings.

FIG. 3 graphically illustrates output waveforms representative of outputs be generated by the power supply circuit 210 and feedback circuit 220. Graph 300 illustrates an output voltage waveform 302 taken at output node 218 supplied by the power supply circuit 210. Graph 306 has a Y-axis 310 that corresponds to voltage and an X-axis 312 that corresponds to time. As shown in graph 300, the output voltage waveform 302 is represented by saw tooth ripple that rides on a DC offset 306 that has a value of $V_{OS1}$. The output voltage waveform 302 has an amplitude 308 that is determined by the difference between peak voltages $V_X$ and $V_Y$. Also shown in graph 300 is a periodic pulse 304. The periodic pulse 304 is operable to control the switch 230. When the periodic pulse 304 is high the switch 230 is closed and the power supply 200 is connected to the load 240. When the periodic pulse 304 is low the switch 230 is open and the power supply circuit 210 is disconnected from the load 240.

At time $T_X$ the switch 230 closes and the power supply 200 connects to the load 240. When the switch 230 closes at time $T_X$ a charge transfer from the capacitive element 216 to the load 240 occurs for a charge transfer period 330, which can last from about 10 to about 400 nanoseconds. This charge transfer causes the voltage at the output node 218 to decrease from the voltage $V_Y$ to the voltage $V_X$. The switch 230 can be closed for a period in the range between about 1 to about 10 microseconds such that during this time the power supply 210 is supplying the load 240 with a voltage. At time $T_Y$, the switch 230 is open and the power supply circuit 210 is disconnected from the load 240. After the charge transfer period 330 and during the period between time $T_Y$ and time $T_Z$ the capacitive element 216 is recharged and the voltage at the output node 218 steadily increases as reflected by the output voltage waveform 302. When the switch 230 is closed again at time $T_Z$ another charge transfer occurs and the voltage of the output node 218 again drops as reflected by the output waveform 302.

Graph 350, illustrates the affect on the voltage of output node 218 in accordance with the teachings disclosed herein, and as shown by an output voltage waveform 352, when the capacitance of the load 240 is incrementally increased. In graph 350 the amplitude 358 of the saw-tooth ripple of the output waveform 352 is increased as compared to the amplitude 308 of the saw-tooth ripple of the output voltage waveform 302, but the output voltage after a charge transfer from the power supply circuit 210 to the load 240 remains at the voltage $V_X$. A result of the present teachings, the output voltage after the charge transfer is, therefore, regulated at the voltage $V_X$, despite an increase in the capacitance of the load 240. The affect of regulating the output voltage after a charge transfer for an increased load capacitance is the average DC offset 306 increases from a voltage $V_{OS1}$ to the average DC offset 356 of a voltage $V_{OS2}$ since the amplitude 308 increase to the amplitude 358 but the voltage after the charge transfer remains regulated at $V_X$. It is therefore observed that the presently taught regulation scheme facilitates providing precise regulation of the value of the output voltage at the output node 218 of the power supply 200 following a charge transfer from the power supply 200 to the load 240.

Figure 4A:
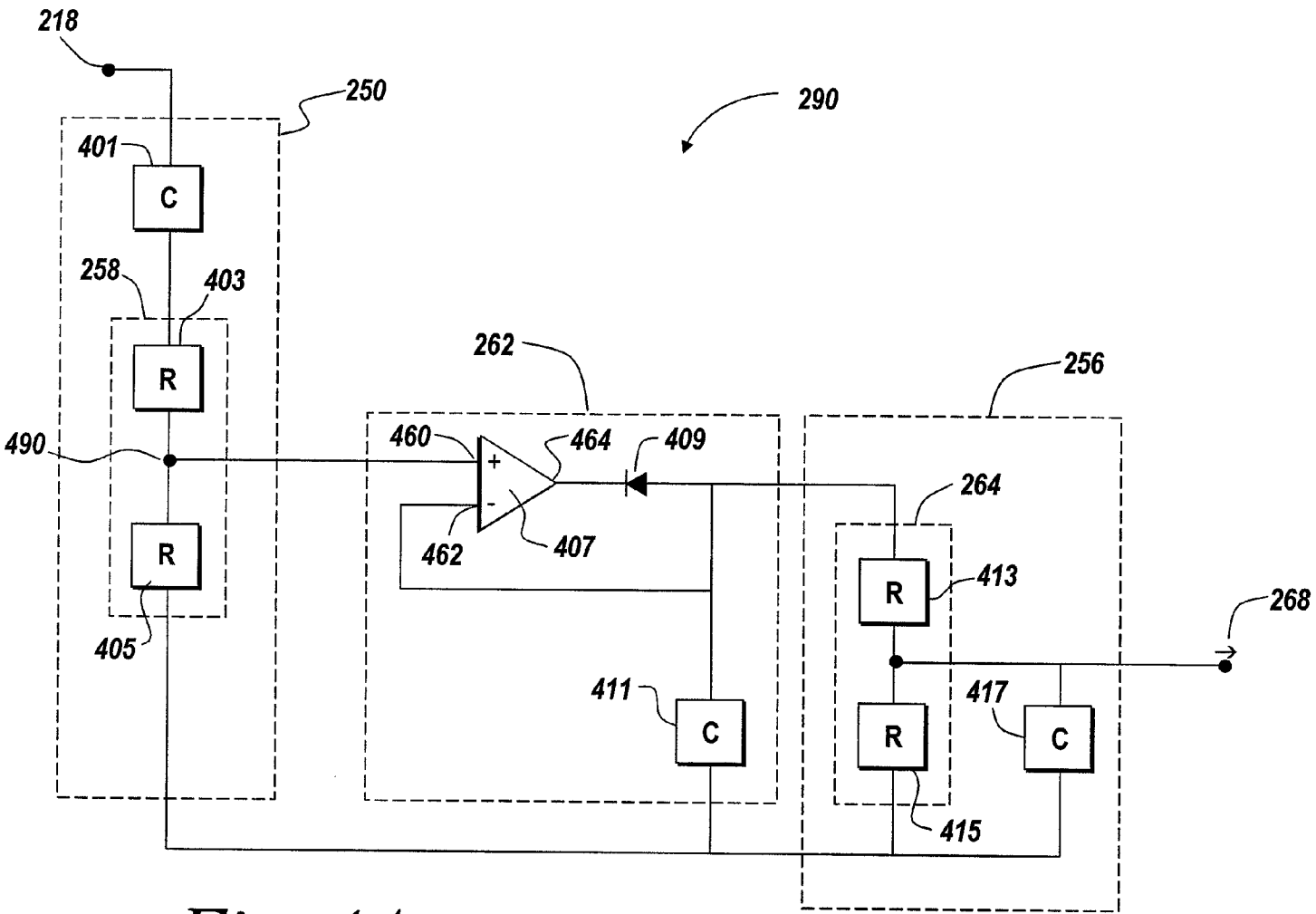
FIG. 4A depicts one various embodiment of a second feedback loop that manipulates an AC component of an output voltage of a power supply.

FIG. 4A illustrates one exemplary embodiment of the second feedback loop 290 of the feedback circuit 220, which receives the AC component of the output voltage from the output node 218. The second feedback loop includes the AC coupler 250, the divider 258, the signal conditioner 262, the divider 264 and the filter 256.

The output node 218 of the power supply circuit 210 is AC coupled by the AC coupler 250 to the divider 258. The AC coupler 250 includes a capacitor 401, a first resistor 403, and a second resistor 405. The AC coupler 250 functions to block the DC component of the output voltage. The AC coupler 250 is coupled to the divider 258, which can be a voltage divider formed by the first and second resistors 403 and 405, and that has a node 490. The divider 258 divides the amplitude of the voltage of the second feedback signal after the second feedback signal is AC coupled by the AC coupler 250. The value of the divider 258 is determined by the values of the first and second resistors 403 and 405. The signal conditioning circuit 262 is coupled to the node 490 of the divider 258.

The signal conditioning circuit 262 can be a half wave rectifier or a negative peak detector. The signal conditioning circuit 262 can include an operational amplifier 407, a diode 409 and a capacitor 411. The operational amplifier 407 has a positive terminal 460, a negative terminal 462, and an output terminal 464. The positive terminal of the operation amplifier 407 is coupled to the node 490 of the divider 258. The output terminal 464 of the operation amplifier 407 is coupled to the cathode of the diode 409. The anode of the diode 409 is coupled to the negative terminal 462 of the operational amplifier 407 to provide negative feedback and to a capacitor 411. The signal conditioning circuit 262 operates to convert the negative peaks of the second feedback signal into a DC component, thereby, rectifying the second feedback signal. The anode of the diode 409 is also coupled to the divider 264. While the descriptive terminology applies to a positive supply voltage, one skilled in the art will recognize that the present teachings can be applied to a negative supply voltage as well.

The divider 264 can be a voltage divider represented by third resistor 413 and fourth resistor 415. The divider 264 operates to divide the amplitude of the rectified second feedback signal. The value of the divider 264 is determined by the values of the third and fourth resistors 413 and 415. The values of the first and second resistors 403 and 405 of the divider 258 and the value of the third and fourth resistors 413 and 415 of the divider 264 are chosen such that the product of the ratios of the dividers 258 and 264 is substantially equal to the ratio of the divider 252 of the first feedback loop 280.

The divider 264 is coupled to the filter 256, which can be a low pass filter that includes a capacitor 417 and can share the third and fourth resistors 413 and 415 with the divider 264. The low pass filter filters the feedback signal and passes the filtered feedback signal to the summing circuit 268. The filter 256 can be configured to have separate and distinct resistors from divider 264. The filter 256 can be configured to include active components, such as operational amplifiers.

Figure 4B:
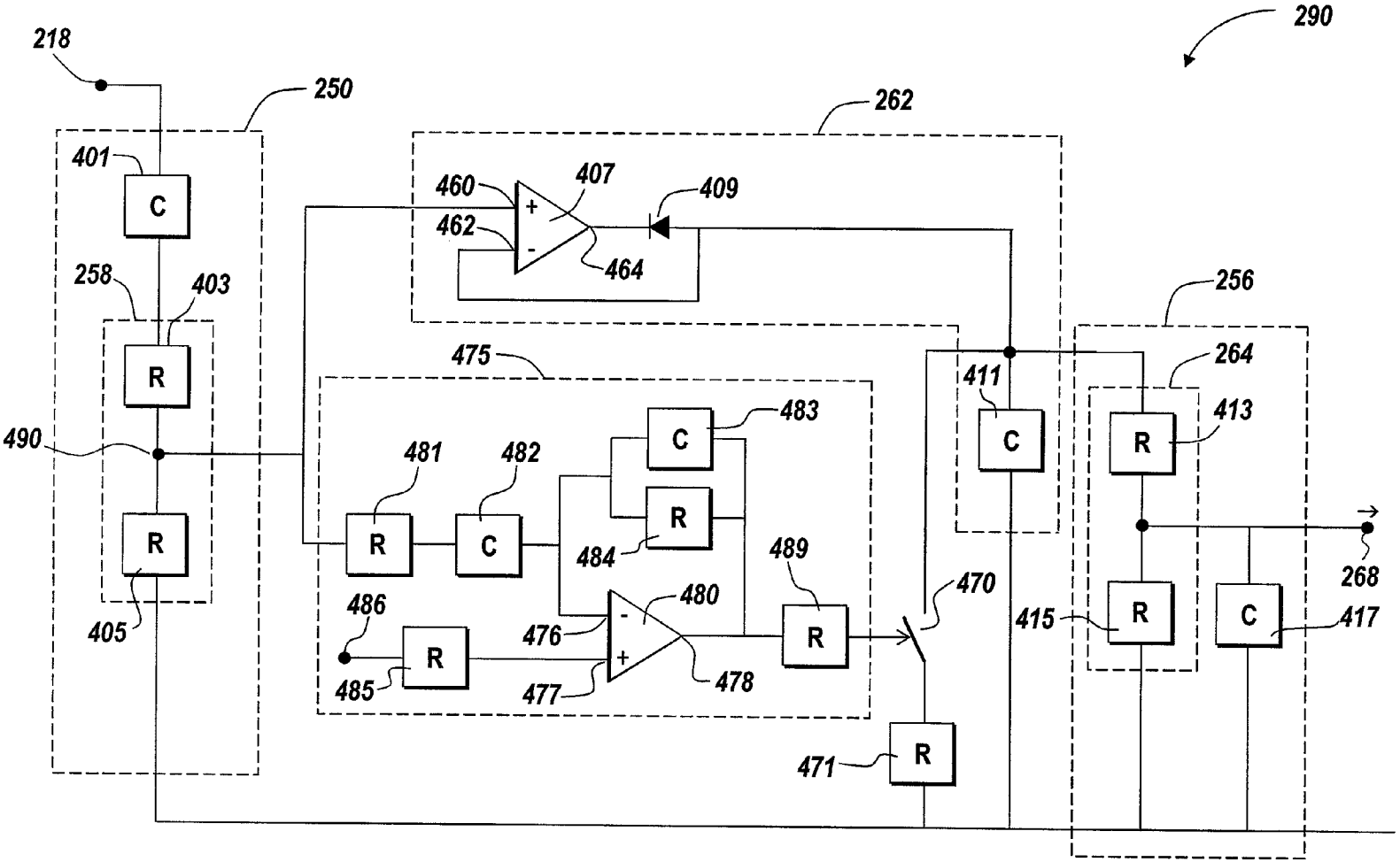
FIG. 4B depicts another various embodiments of the second feedback loop that manipulates the AC component of the output voltage of a power supply.

FIG. 4B illustrates an alternative circuit topology for the second feedback loop 290 for the feedback circuit 220, which manipulates the AC component of the output voltage at the output node 218. The alternative circuit topology for the second feedback loop 290 includes the AC coupler 250, the dividers 258 and 264, the signal conditioning circuit 262, a differentiator circuit 475, a switch 470, a resistor 471, and the filter 256.

The output node 218 of the power supply 200 is AC coupled by the AC coupler 250 to the divider 258. The AC coupler 250 includes the capacitor 401, and the resistors 403 and 405, and functions to block the DC component of the output voltage. The AC coupler is coupled to the divider 258, which can be a voltage divider represented by a node 490, the first resistor 403 and the second resistor 405, which are shared with the AC coupler 250. The divider 258 divides the amplitude of the voltage of the second feedback signal by a value determined by the values of the first and second resistors 403 and 405. The divided value of the second feedback signal is output from the divider 258 at the node 490. The signal conditioning circuit 262 and the differentiator 475 are coupled to the node 490 of the divider 258.

The signal conditioning circuit 262 can be a half wave rectifier or a negative peak detector. The signal conditioning circuit can include an operational amplifier 407, a diode 409 and a capacitor 411. The operational amplifier 407 has a positive terminal 460, a negative terminal 462, and an output terminal 464. The positive terminal of the operational amplifier 407 is coupled to the node 490 of the divider 258. The output terminal 464 of the operation amplifier 407 is coupled to the cathode of the diode 409. The anode of the diode 409 is coupled to the negative terminal 462 of the operational amplifier 407, the capacitor 411, and to a switch 470. The signal conditioning circuit 262 operates to convert the negative peaks of the second feedback signal into a DC component, thereby, rectifying the feedback signal. The capacitive element 411 is operative to store the charge associated with the rectified signal. The charge of capacitive element 411 discharges with a time constant based on the values of resistors 413 and 415 and capacitive element 417 when the switch 470 is open. The anode of the diode 409 of the signal conditioning circuit 262 is also coupled to the divider 264.

The differentiator circuit 475 includes resistors 481, 484, 485, capacitors 482 and 483, an operation amplifier 480, and an optional resistor 489. The resistor 481 is coupled to the node 490 of the divider 258 and to the capacitor 482. The capacitor 482 is coupled to a negative terminal 476 of the operational amplifier 480, the resistor 484, and the capacitor 483. The capacitor 483 and the resistor 484 are in turn coupled to the output terminal 478 of the operational amplifier 480 and the optional resistor 489. The optional resistor 489 is coupled to switch 470 or if the optional resistor 489 is not used the output terminal 478 of the operational amplifier 480 is coupled to switch 470. The positive terminal of the operational amplifier 480 is coupled to the resistor 485, which is coupled to an output node 486 of a bias voltage source (not shown). The differentiator is operable to open and close switch 470 based on a comparison between a derivative of the divided AC component of the feedback signal and a bias voltage from the bias voltage source. When the magnitude of the derivative of the divided AC component of the feedback is larger than the bias voltage, the differentiator 475 closes the switch. When the magnitude of the derivative of the AC component of the feedback signal is smaller than the bias voltage the differentiator 475 opens the switch.

The switch 470 is operable to connect a resistor 471 to the output of the signal conditioning circuit 262, thereby placing the resistor 471 in parallel with the capacitor 411 of the signal conditioning circuit 262. The affect of connecting the resistor 471 in parallel with the capacitor 411 is a reduction in the time it takes the capacitor 411 to discharge (e.g., a faster time constant). This enables the feedback circuit 220 to react more quickly to sudden decreases in a capacitance of the load 240. While the resistor 471 is depicted between the switch 470 and a return path, the resistor 471 can be between the switch 470 and the anode of the diode 409 of the signal conditioning circuit 262.

The divider 264 can be a voltage divider represented by the third resistor 413 and the fourth resistor 415. The divider 264 operates to divide the amplitude of the rectified feedback signal. The value of the divider 264 is determined by the values of the third and fourth resistors 413 and 415. The values of the first and second resistors 403 and 405 of the divider 258 and the value of the third and fourth resistors 413 and 415 of the divider 264 are chosen such that the product of the ratios of the dividers 258 and 264 is substantially equal to the ratio of the divider 252 of the first feedback loop 280.

The divider 264 is coupled to the filter 256, which can be a low pass filter that includes a capacitor 417 and shares the resistors 413 and 415 with the divider 264. The low pass filter filters the feedback signal and passes the filtered feedback signal to the summing circuit 268. The filter 256 can be configured to have separate and distinct resistors from divider 264. The filter 256 can be configured to include active components, such as operational amplifiers.

FIGS. 5A-D are flow diagrams depicting steps taken to practice various embodiments of the present teachings.

Figure 5A:
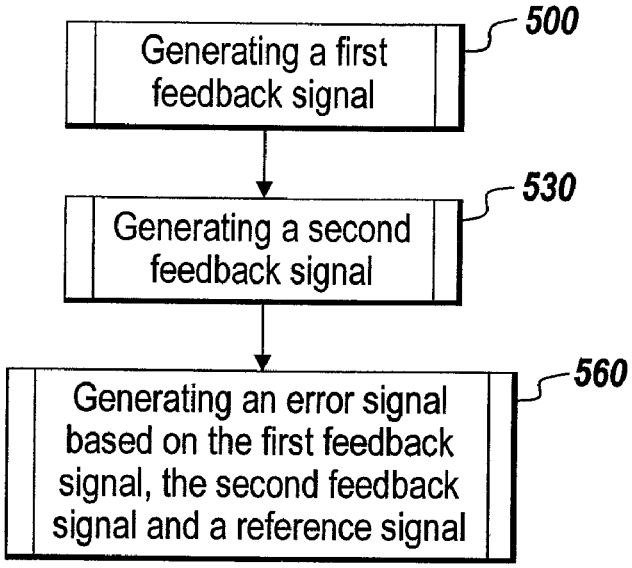
FIG. 5A depicts a flow diagram of steps taken to practice various embodiments of the present teachings.

FIG. 5A depicts a flow diagram of the steps taken to generate an error signal for regulating the output voltage of the power supply 200. In steps 500 and 530, a first and a second feedback signal are generated, respectively. In step 560, an error signal based on the first feedback signal, the second feedback signal and a reference signal is generated.

Figure 5B:
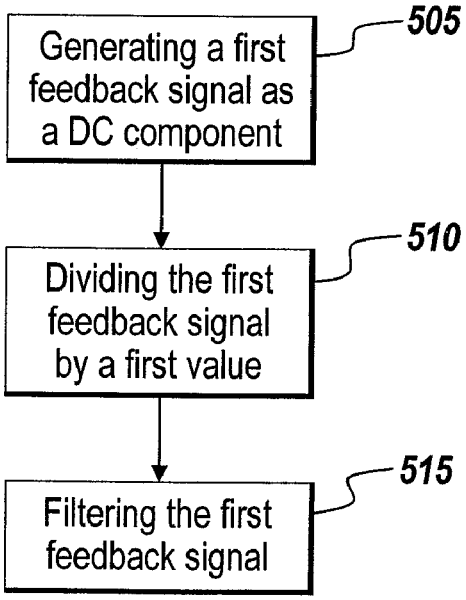
FIG. 5B depicts a more detailed flow diagram of the steps performed in step 600 of FIG. 5A.

FIG. 5B depicts in more detail various aspects of the step 500 of the present teachings. In various aspects, the present teachings generate a first feedback signal representative of a DC component of the output voltage of the power supply 200 (step 505), and, in turn, divides the first feedback signal by a first value (for example N) (step 510). In step 515, the first feedback signal is filtered.

Figure 5C:
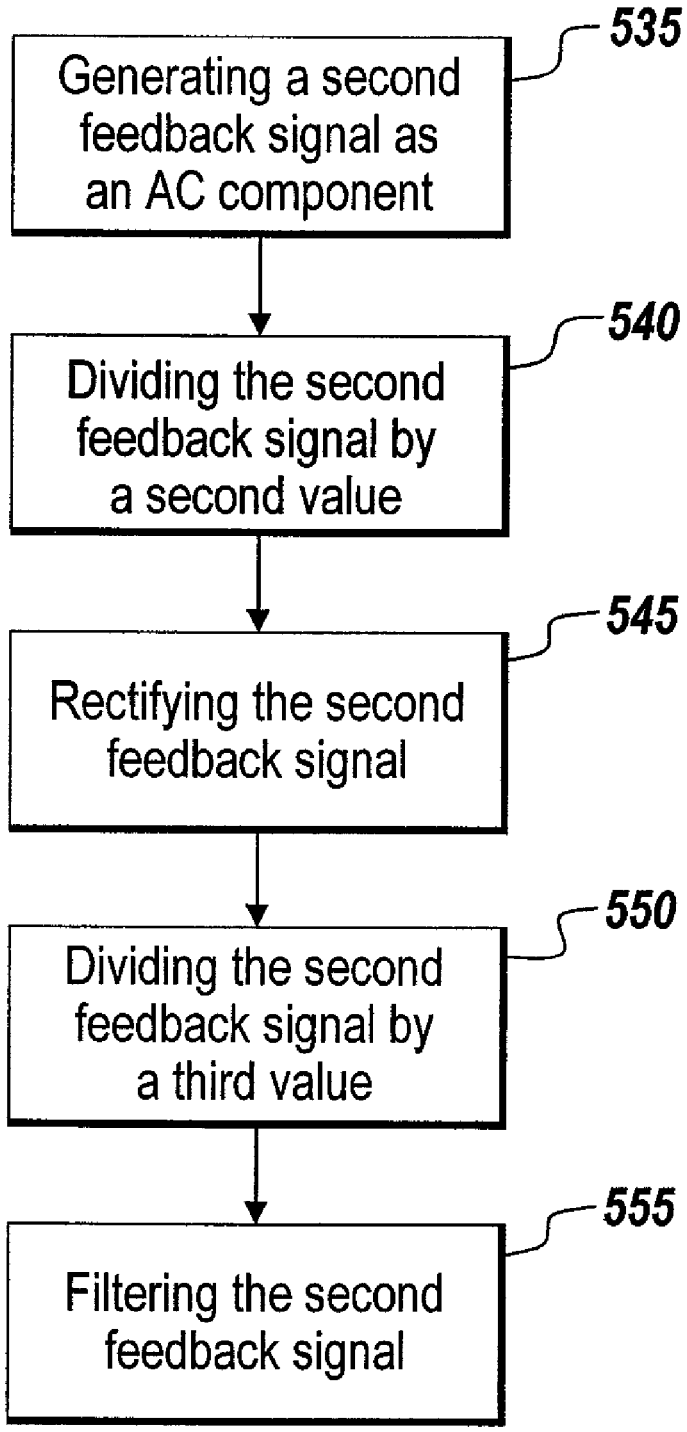
FIG. 5C depicts a more detailed flow diagram of the steps performed in step 630 of FIG. 5A.

FIG. 5C depicts in more detail various aspects of the step 530 of the present teachings. In various aspects, the present teachings generate a second feedback signal representative of an AC component of the output of the power supply circuit (step 535). The second feedback signal is divided by a second value (for example 1/J) (step 540). After being divided, the second feedback signal is rectified (step 545). The second feedback signal, having been once divided and rectified, is divided by a third value (for example 1/K) (step 550). The values are chosen such that the resultant of the second value and the third value is substantially equal to the first value. In step 555, the second feedback signal, having been divided by the second value, rectified and subsequently divided by the third value is filtered.

Figure 5D:
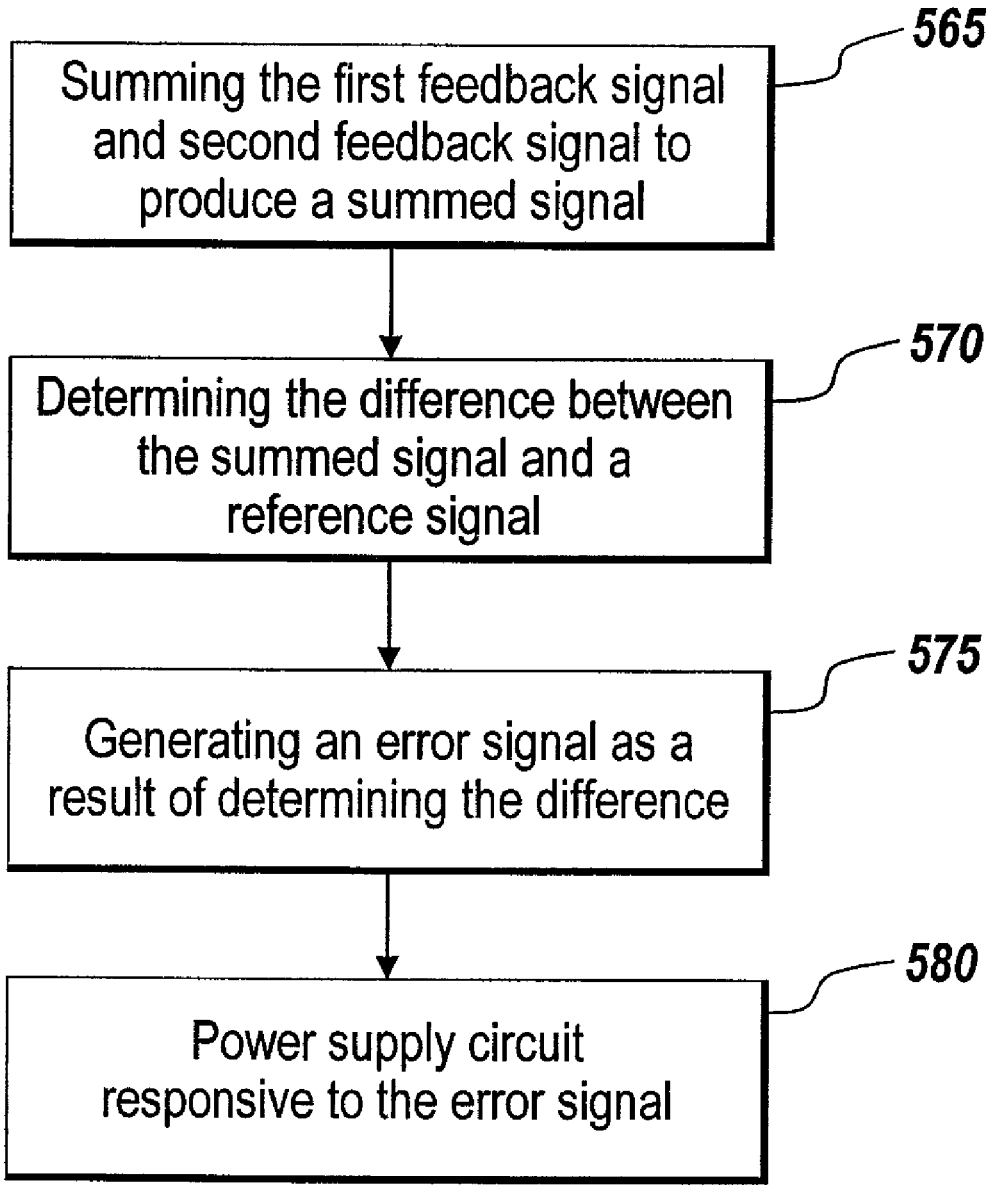
FIG. 5D depicts a more detailed flow diagram of the steps performed in step 660 of FIG. 5A.

FIG. 5D depicts in more detail various aspects of the step 560 of the present teachings. In various aspects, the present teachings teach the summing of the first and second feedback signals to produce a summed signal (step 565). The difference between the summed signal and a reference signal is determined (step 570) and an error signal is generated as result of the difference (step 575). The power supply circuit is responsive to the error signal to regulate the output of the power supply circuit (step 580).

The power supplies, power supply circuits, and feedback circuits of the present teachings can be used in mass spectrometry systems and, in various embodiments, find particular use where voltage switching is desired. Examples of voltage switching in mass spectrometers to which various embodiments of the present teachings can be applied include, but are not limited to, pulsed ion sources, delayed extraction ion sources, ion fragmentor extraction, and ion deflection. Ion sources are one application where precise control of the voltage, and hence the energy imparted to ions, is desired.

The power supplies, power supply circuits, and feedback circuits of the present teachings can be used in a wide variety of mass spectrometry instruments including, but not limited to, time-of-flight TOF systems such as, for example, MS only systems (e.g., linear TOF and orthogonal TOF (O-TOF) systems), and tandem MS systems (e.g, TOF-TOF and quadrupole TOF (Q-TOF)), and orthogonal (O-TOF) systems. Suitable ion sources for such systems include, but are not limited to, electron impact (EI) ionization, electrospray ionization (ESI), and matrix-assisted laser desorption ionization (MALDI) sources.

Figure 6:
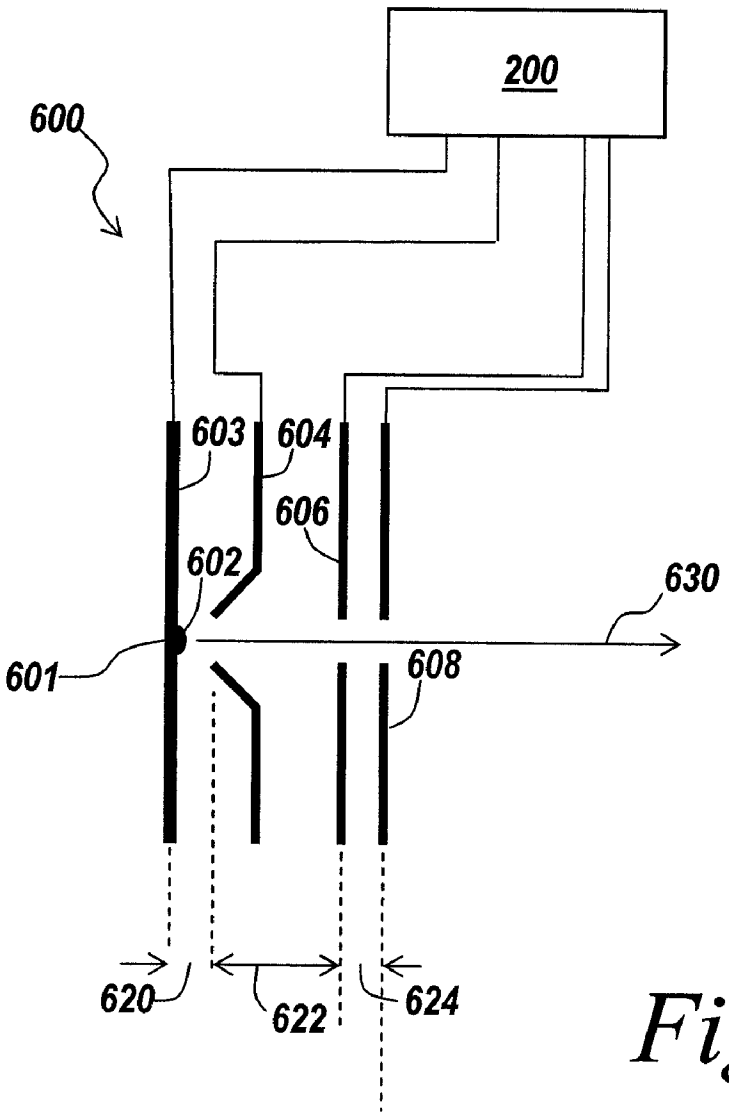
FIG. 6 depicts a block diagram of an ion source of a time of flight mass spectrometer system in accordance with various embodiments of the present teachings.

FIG. 6 schematically depicts an ion source 600 for a mass spectrometer system having a regulated a power supply output in accordance with various embodiments of the present teachings. The source illustrated is a MALDI ion source, but a wide variety of other ion formation methods, including, but not limited to, EI and ESI, can be used. In various embodiments, the present teachings provide a MALDI ion source for a mass spectrometer, the ion source comprising a sample support 601 that can support a sample 602 on a sample surface 603, the sample support serving as a first electrode, and a second electrode 604. A variety of electrode shapes and configurations can be used including, but not limited to, plates, grids, cones, and combinations thereof.

In various embodiments, a power source 200, is electrically coupled to each of the sample surface 603 and the second electrode 604. The sample surface 603, the second electrode 604, or both, being representative of the load 240. The power source 200 can be configured to establish at least in a first region 620 a first extraction electric field at a predetermined time that accelerates sample ions of interest in a first direction 630 away from the sample surface. The power supply 200 can, for example, establish the first extraction electric field by changing the potential on one or more of the sample surface 603 and the second electrode 604. In various embodiments, an electrical potential is applied to one or more of the sample surface and second electrode to establish the first extraction electrical field. In various embodiments, one or more of the sample surface and second electrode are connected to a ground, either an absolute or floating ground, and the electrical potential changed on the element not grounded.

In various embodiments, the power source 200 uses the feedback circuit 220 of the present teachings to regulate the output voltage of each of the power supply 200 following a charge transfer from the power supply to one or more of the sample surface 603 and the second electrode 604 providing a predetermined electrical potential difference between the sample surface 603 and the second electrode 604 for accelerating or decelerating the ions. In various embodiments, this potential difference is provided at a predetermined time to effect, for example, delayed extraction.

In various embodiments, the ion source can be configured to establish electrical potential differences in than more than one region, such as, for example, in a multi-field ion source. These electrical potential differences can be applied using one or more power supplies of the present teachings. For example, in various embodiments the ion source includes a third electrode 606 and a fourth electrode 608 that are spatially separated from each other, the sample support 601 and the first electrode 604. The third and fourth electrodes can be used to establish across a second region 622 and/or a third region 624 additional electrical fields, such as, for example, a spatial focus electrical field(s) that spatially focuses sample ions of interest in a direction substantially perpendicular to an extraction direction 630.

The power source 200 can comprise a single device, multiple stand-alone devices, multiple integrated devices, or combinations thereof. For example, in various embodiments using a three field source, a power source can include a first power supply represented, e.g., by a power supply 200A, which includes the power supply circuit 210 and the feedback circuit 220, where the first power supply is electrically coupled through a switch to one or more of the sample support and the second electrode; a second supply represented, e.g., by the power supply 200B, which includes the power supply circuit 210 and is coupled to the feedback circuit 220, where the second power supply is electrically coupled through a switch to one or more of the second electrode and the third electrode, and a third power supply represented, e.g., by the power supply 200A electrically coupled through a switch to one or more of the third electrode and the fourth electrode. In various embodiments, a power supply provides a voltage that is in the range between about 5,000 volts to about 30,000 volts.

Figure 7A:
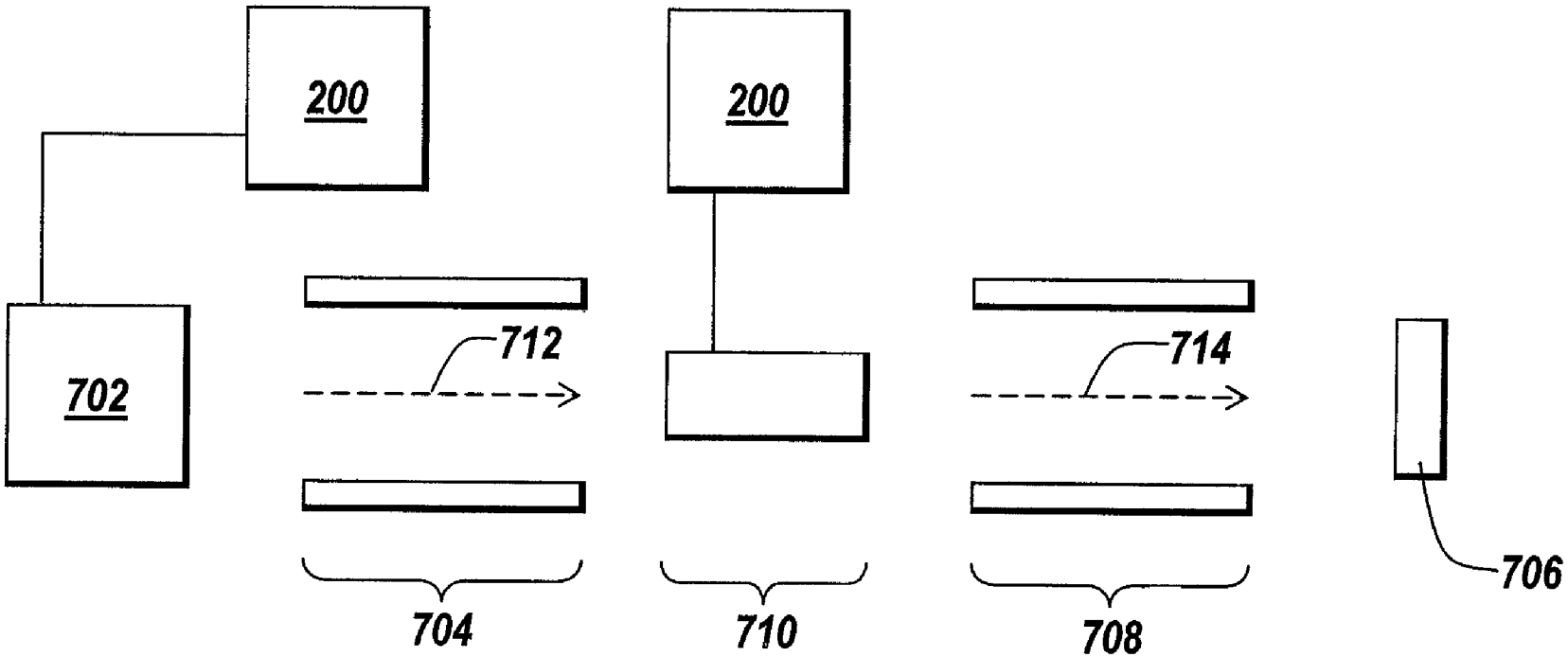
FIGS. 7A and 7B depict block diagrams of various mass spectrometer systems in accordance with various embodiments of the present teachings.
Figure 7B:
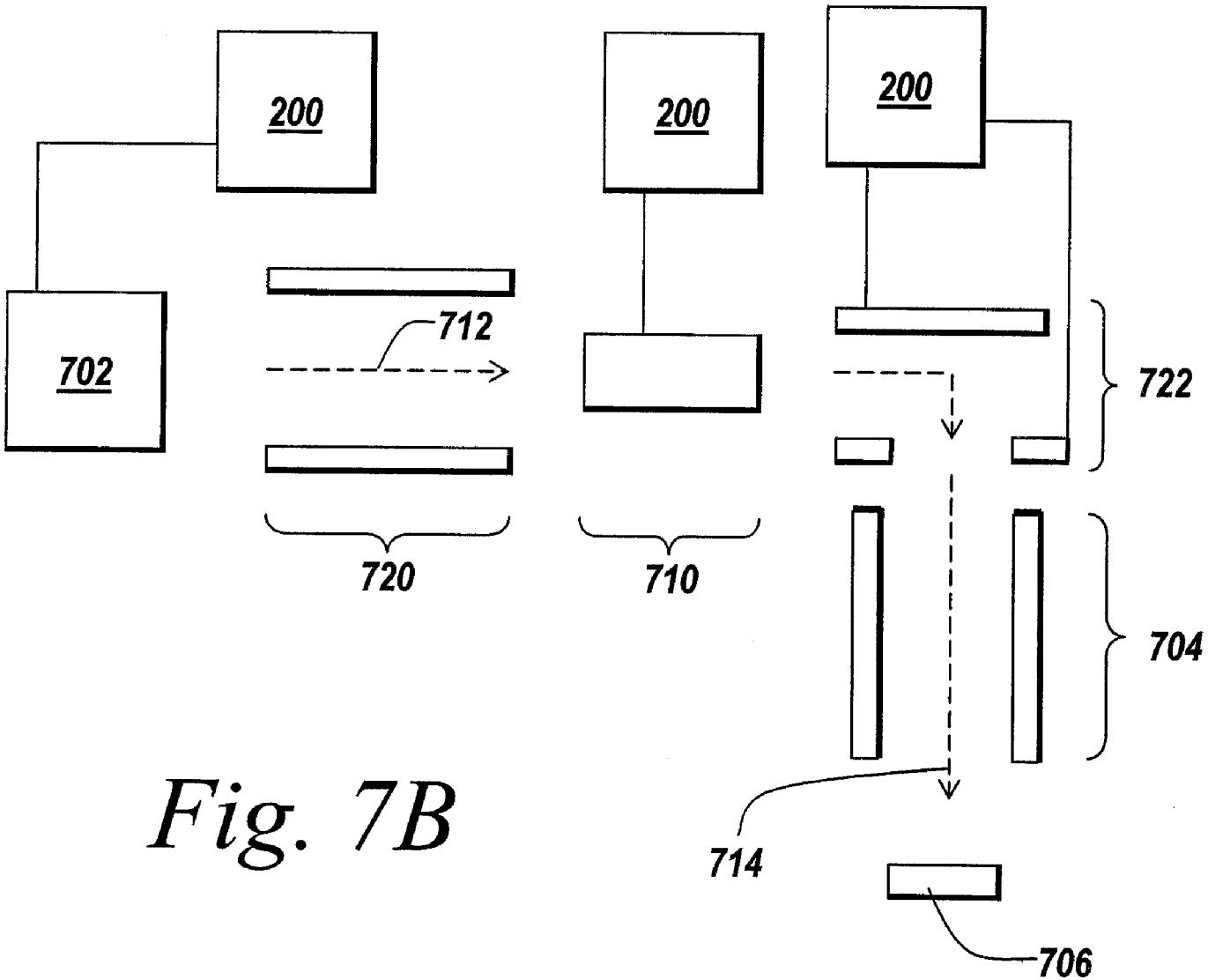

FIGS. 7A and 7B schematically depict various mass spectrometer systems comprising one or more power supplies 200 having a regulated output in accordance with various embodiments of the present teachings. In various embodiments, the mass spectrometer system includes an ion source 702, a first TOF region 704, and an ion detector 706. Suitable structures for TOF regions include, but are not limited to, drift tubes and RF multipole ion guides. Suitable ion detectors include, but are not limited to, electron multiplies, channeltrons, microchannel plates (MCP), and charge coupled devices (CCD). In various embodiments, the systems comprise a TOF-TOF mass spectrometer, having a second TOF region 708 and potentially an ion interaction region 710. Examples of ion interaction regions include ion fragmentors and ion deflectors. A power supply 200, having a regulated output in accordance with various embodiments of the present teachings, is electrically coupled to the ion source 702, an ion interaction region 710, or both.

Suitable ion fragmentors include, but are not limited to, those operating on the principles of: collision induced dissociation (CID, also referred to as collisionally assisted dissociation (CAD)), photoinduced dissociation (PID), surface induced dissociation (SID), post source decay, or combinations thereof. Examples of suitable ion fragmentors include, but are not limited to, collision cells (in which ions are fragmented by causing them to collide with neutral gas molecules), photodissociation cells (in which ions are fragmented by irradiating them with a beam of photons), and surface dissociation fragmentors (in which ions are fragmented by colliding them with a solid or a liquid surface). Examples of ion deflectors include timed ion selectors and ion deflectors for orthogonal TOF.

In various embodiments, a power source 200 uses the power supply circuit 210 and the feedback circuit 220 of the present teachings to regulate the output voltage of the power source 200 following a charge transfer from the power supply to one or more electrodes of the ion source 702, ion interaction region 710, or both, providing a predetermined electrical potential difference for, for example, accelerating or decelerating ions. The power source 200 can comprise a single device, multiple stand-alone devices, multiple integrated devices, or combinations thereof. In various embodiments, this potential difference is provided at a predetermined time to effect, for example, delayed extraction from an ion source, ion selection with ion deflectors, delayed extraction from a collision cell, orthogonal deflection into another mass analyzer, etc.

Referring to FIG. 7A, in various embodiments, ions are extracted from the ion source and transmitted along a first trajectory 712 through a first TOF region 704 and detected with an ion detector 706. In various embodiments, the systems comprise a second TOF region 708 and an ion interaction region 710. Ions emerge from the interaction region 710 and are transmitted along a second trajectory 714 through a second TOF region before detection by a detector 706.

Referring to FIG. 7B, various embodiments of an orthoganol TOF (O-TOF) are depicted. Examples of commercially available O-TOF instruments having the salinet features schematically depicted in FIG. 7B include, but are not limited to the Q-STAR™ brand series of instruments available from Applied Biosytems/MDS Sciex. Suitable mass analyzers 720 include, but are not limited RF multipole ion guides, RF multipole ion filters (e.g., quadrupoles), drift tubes, and magnetic and/or electrostatic sectors. In various embodiments, an O-TOF instrument comprises an ion source 702, a first mass analyzer 720, an ion interaction region 710 configured as an ion fragmentor, a pulsed deflector 722, a TOF region 704 and an ion detector 706. In various embodiments, an ion mirror can be included between the TOF region 704 and ion detector 706 to, e.g., improve instrument performance by correcting, for example, for differences in energy between ions for the same mass-to-charge ratio value. In operation, an O-TOF generally transmits ions from the source 702 along a first trajectory 712 and at a predetermined time a power source 200 applies a voltage pulse to a deflector 722 to direct ions onto a second trajectory 714 substantially perpendicular to the first trajectory 712. In accordance with the present teachings, the ions are deflected by application at a predetermined time of potential difference using the power supply 200 to accelerate ions substantially perpendicular to the first trajectory 712 and onto the second trajectory 714. In various embodiments, the deflector 722 serves as a virtual ion source for the TOF region 704. In various embodiments, a power source 200 uses the power supply circuit 210 and the feedback circuit 220 of the present teachings to regulate the output voltage of the power source 200 following a charge transfer from the power supply to one or more electrodes of the ion deflector 722.

In various embodiments, an O-TOF instrument comprises an ion interaction region 710 configured as a collision cell. In various embodiments, the output of the collision cell comprises an electrode to which a pulsed voltage can be applied by a power source 200 to accelerate ions out of the collision cell at a predetermined time, which can, for example, serve as a timing point, virtual ion source, or both for the ion deflector 722.

As illustrative in the above discussion, the present teachings facilitate providing precise regulation of an output voltage following a charge transfer from a power supply to a load. In various embodiments, the present teachings can provide time of flight mass spectrometer systems with an increased ability to regulate an output voltage following a charge transfer from a power supply to a load. The output voltage following a charge transfer can be of particular importance in a time of flight mass spectrometer system where this voltage determines the acceleration of an ion, which, e.g., may determine its time-of-flight through an instrument and ultimately be used to determine the mass of the ion. Slight variation in this voltage causes variations in the speed of the ion, and therefore, the time it takes the ion to reach a detector. As a result, unwanted variations in the flight time can lead to uncertainty in the ion mass determination. Accordingly, various embodiments of the present teachings can provide time of flight mass spectrometer systems with more precise control over the energy imparted to the ions in various stages of the instrument, and as a result, improved precision in the measurement of ion mass.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art.

What is claimed is:

1. In a mass spectrometer, a method for regulating an output of a power supply circuit coupled to an ion source or ion interaction region having at least a first electrode and a second electrode, said method comprising the steps of:

receiving a first feedback signal from the output of the power supply circuit; receiving a second feedback signal from a ripple component of the output of the power supply circuit;

summing the first feedback signal and the second feedback signal to generate a summed signal;

determining a difference between a reference signal and the summed signal; and generating an error signal based on the difference between the summed signal and the reference signal, whereby the power supply circuit is responsive to the error signal to regulate the voltage applied to the at least one electrode of the ion source.

2. The method of claim 1, wherein the step of generating the error signal comprises the steps of: dividing the first feedback signal according to a first value; and dividing the second feedback signal according to a second value.

3. The method of claim 1, wherein the step of generating the error signal further comprises the step of, conditioning the second feedback signal to generate a rectified signal.

4. The method of claim 1, wherein the step of generating the error signal further comprises the step of, dividing the rectified signal according to a third value.

5. The method of claim 1, further comprising the steps of: filtering the first feedback signal; and filtering the second feedback signal.

* * * * *